United States Patent [19]

Sweitzer

[11] 4,334,517

[45] Jun. 15, 1982

[54] HEAT EXCHANGER UNIT

[76] Inventor: Bruce Sweitzer, Rte. 2, Box 20-A, Swanton, Md. 21561

[21] Appl. No.: 52,609

[22] Filed: Jun. 27, 1979

[51] Int. Cl.[3] ..... F24B 7/00; F24B 1/02; F23J 1/06

[52] U.S. Cl. ..... 126/121; 126/163; 126/244

[58] Field of Search ..... 126/164, 163, 121, 243, 126/244, 245, 58

[56] References Cited

U.S. PATENT DOCUMENTS

| | | | |
|---|---|---|---|
| 398,007 | 2/1889 | Story | 126/164 |
| 1,457,660 | 6/1923 | Holloway | 126/58 |
| 3,635,211 | 1/1972 | Englert | 126/121 |
| 3,955,553 | 5/1976 | Soeffker | 126/163 R |
| 4,010,729 | 3/1977 | Eggley | 126/121 |
| 4,078,542 | 3/1978 | Young et al. | 126/164 |
| 4,122,825 | 10/1978 | Slate | 126/121 |

*Primary Examiner*—Samuel Scott
*Assistant Examiner*—Wesley S. Ratliff, Jr.
*Attorney, Agent, or Firm*—Haight & Associates

[57] ABSTRACT

A heat exchanger unit (20) is provided to be placed upon a fireplace floor (17) and attached to a heatalator or heat form (57) to enhance the heating efficiency of a conventional fireplace. The unit receives room air through apertures (33) in its front wall (21) and conducts the cool air through a plurality of upwardly angled tubes (40) toward the rear wall (25) of the unit as the air is continuously heated by the surrounding kindling wood (18), charcoal and ashes. Mounting holes (41) are provided on the rear wall of the unit in order to attach the heat exchanger to the rear wall (13) of the fireplace. Grate holes (30) are positioned along the bottom wall and are capable of being aligned with a plurality of shaker holes (52) formed in at least one shaker grate (51) slidable over the bottom wall which is positioned in at least one elongated aperture (37) formed in the front wall. By its attachment to an existing heatalator or heat form, the heat exchanger unit is capable of overcoming the deficiencies of conventional fireplace heat exchangers which are self-contained units not coordinated with existing fireplace structure which are consequently unable to enhance the heat efficient function of the same.

9 Claims, 5 Drawing Figures

HEAT EXCHANGER UNIT

TECHNICAL FIELD OF THE INVENTION

This invention relates generally to heat exchangers, and more specifically to a new and improved heat exchanger unit designed to increase the heating efficiency of a conventional fireplace by being attached to an existing fireplace heatalator or heat form.

BACKGROUND ART

Although conventional fireplaces are intended to produce heat within the rooms within which they are located, their heating capabilities are often unsatisfactory and as a result it is desirable to increase their heating efficiency by situating a heat exchanger within the fireplace. Several problems generally arise when conventional heat exchangers are so situated. One problem is that many of these heat exchangers do not utilize the natural convection of heated air in conducting such air through a fireplace and returning it to the room in which the fireplace is located. Another problem is that most of these heat exchangers do not return heated air to the room at an elevated level but instead return it along the floor where it has little utility in heating the room. Yet another problem is that most heat exchangers are self-contained units which do not cooperate with existing heatalator or heat form structure in order to enhance the heating efficiency of such structure. Still another problem is that many elements of the heat exchangers wear out or burn out and cannot be replaced, or replaced only with great difficulty. Furthermore, conventional heat exchangers are large and unattractive, detracting from the appearance of both the fireplace and the room in which they are situated.

The above-noted problems have remained generally unsolved by the prior art. Slate, U.S. Pat. No. 4,122,825, discloses a fireplace air heater for returning warm air to an adjacent room. A blower unit aids in withdrawing cool air from the room and such cool air is passed through a number of cool air conduits to a warm air manifold. An ash screen and a removable ash pan are positioned below the heater. This device is self-contained, returning heated air along the floor where it is initially received, and it is incapable of being used with an existing heat form or heatalator and therefore does not utilize the convection of heated air to maximum advantage.

Young et al., U.S. Pat. No. 4,078,542, discloses a heat transfer system which includes a plurality of cylindrical conduits for returning heated air to an adjacent room. A blower supplies room air to the conduits and a metal grate receives ashes and coals and can be removed for cleaning. The conduits are not slanted to take advantage of hot air convection and the system is self-contained, therefore being incapable of use with an existing heat form or heatalator.

Eggley, U.S. Pat. No. 4,010,729, discloses a heat exchanger unit comprising a grate which conducts room air adjacent to a fire and through an exhaust transfer duct into an adjacent room. This unit relies upon a blower to propel room air through the system rather than convection currents and it is not designed to be attached to a heat form or heatalator to enhance the heating efficiency of the existing fireplace structure.

The heat exchanger of Englert, U.S. Pat. No. 3,635,211, comprises a generally U-shaped structure which returns heated room air to an adjacent room. Not only is this device large and unattractive, but it cannot be coupled with existing heatalator or heat form structures in order to render them more heat efficient.

Leibst, U.S. Pat. No. 2,702,030, discloses a heat exchanger comprising a plurality of bars which conduct room air into an existing fireplace heating chamber which in turn conducts the heated air into an adjacent room. This device includes an ashtray to receive spent fire wood and coal which falls between the bars. Although this device is coordinated with existing fireplace structure, it does not provide for slanting the tubes to take advantage of the convention of room air as it is heated nor is it self-contained by a frame structure which both houses the tubes and is securely attached to the fireplace.

While all these prior art devices are designed to improve the heat efficiency of a conventional fireplace, none of them are able to simply and inexpensively overcome all of the aforementioned problems. None of these heat exchangers comprises an attractive unit which both utilizes hot air convection by angling the cool air transport tubes through a fireplace fire and cooperates with existing heatalator or heat form structure to render a conventional fireplace more heat efficient. Nor do any of these devices include frame structure which is securely attached to a fireplace rear wall and which retains the transport tubes so that they can be easily replaced. It is apparent that none of these prior art devices overcome all of the noted problems. The present invention fills such a need.

DISCLOSURE OF THE INVENTION

Accordingly, it is a general object of the present invention to provide a new and improved heat exchanger which can be attached to existing fireplace structure.

Another object of the present invention is to provide a new and improved heat exchanger which may be sold as a kit of component parts which can be easily assembled, disassembled and replaced.

A further object of the present invention is to provide a new and improved heat exchanger which occupies only a small portion of the area of a conventional fireplace and which is attractive in design.

An additional object of the present invention is to provide a new and improved heat exchanger to enhance the efficiency of existing fireplace structure by passing heated air through such structure and by taking advantage of the natural convection of heated air.

A more particular object of the present invention is to provide a new and improved heat exchanger capable of disposing of heated ashes without removal of the unit from the fireplace structure.

Upon study of the specification and appended claims, further objects, features and advantages of the present invention will become more fully apparent to those skilled in the art to which this invention pertains.

BRIEF DESCRIPTION OF THE DRAWINGS

The above and other objects, features and advantages of the present invention will be more fully apparent to those of ordinary skill in the art to which this invention pertains from the following detailed description when considered in connection with the accompanying drawings, in which like reference characters designate like or corresponding parts throughout the several views, and wherein.

BEST MODE FOR CARRYING OUT THE INVENTION

Briefly, the above and other objects, features and advantages of the present invention are attained in one aspect thereof by providing a heat exchanger unit for placement along the floor of a fireplace and for connection to a fireplace heat form or heatalator. The heat exchanger includes a unitary frame having front and rear walls which extend upwardly from opposite sides of a generally rectangular bottom wall. Means for supporting the frame above the fireplace floor, for attaching the rear frame wall to a fireplace wall and for conducting room air through the frame to a heatalator or heat form are all associated with the heat exchanger. Positioned adjacent to and along the bottom wall is means for removing ashes from the heat exchanger unit.

Figure 1:
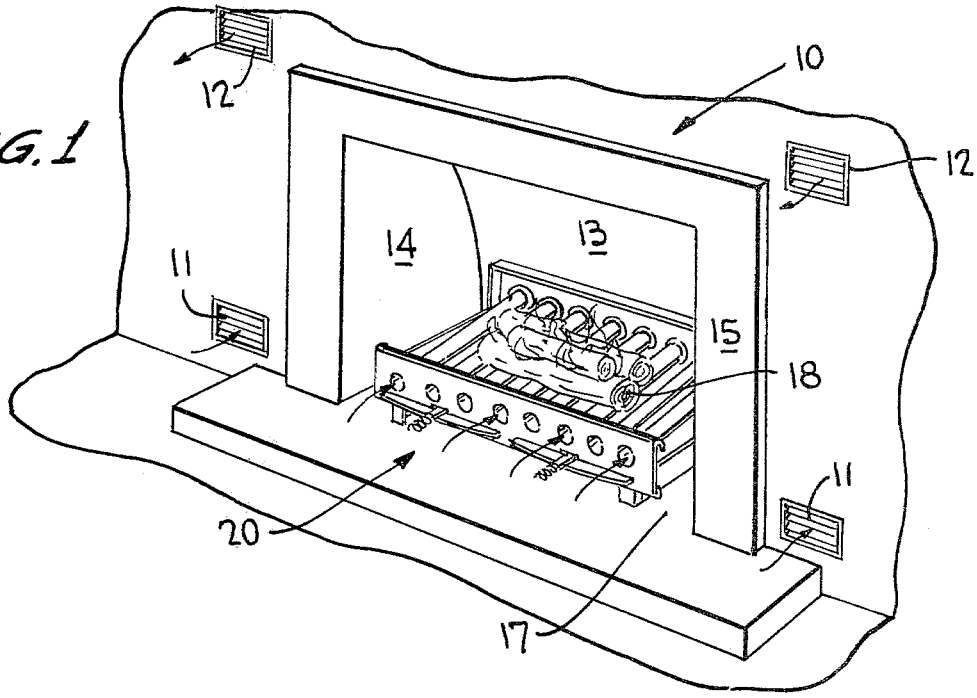
FIG. 1 is a perspective view of the heat exchanger of the present invention as situated within a conventional fireplace.
Figure 3:
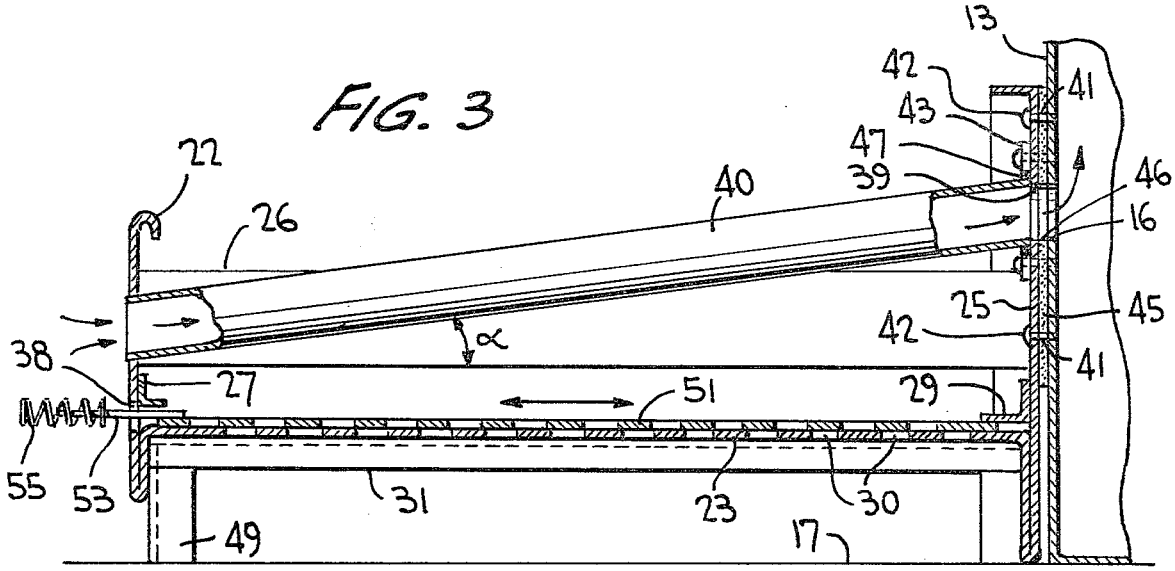
FIG. 3 is a cross-sectional view of the heat exchanger taken along line 3—3′ of FIG. 2.
Figure 4:
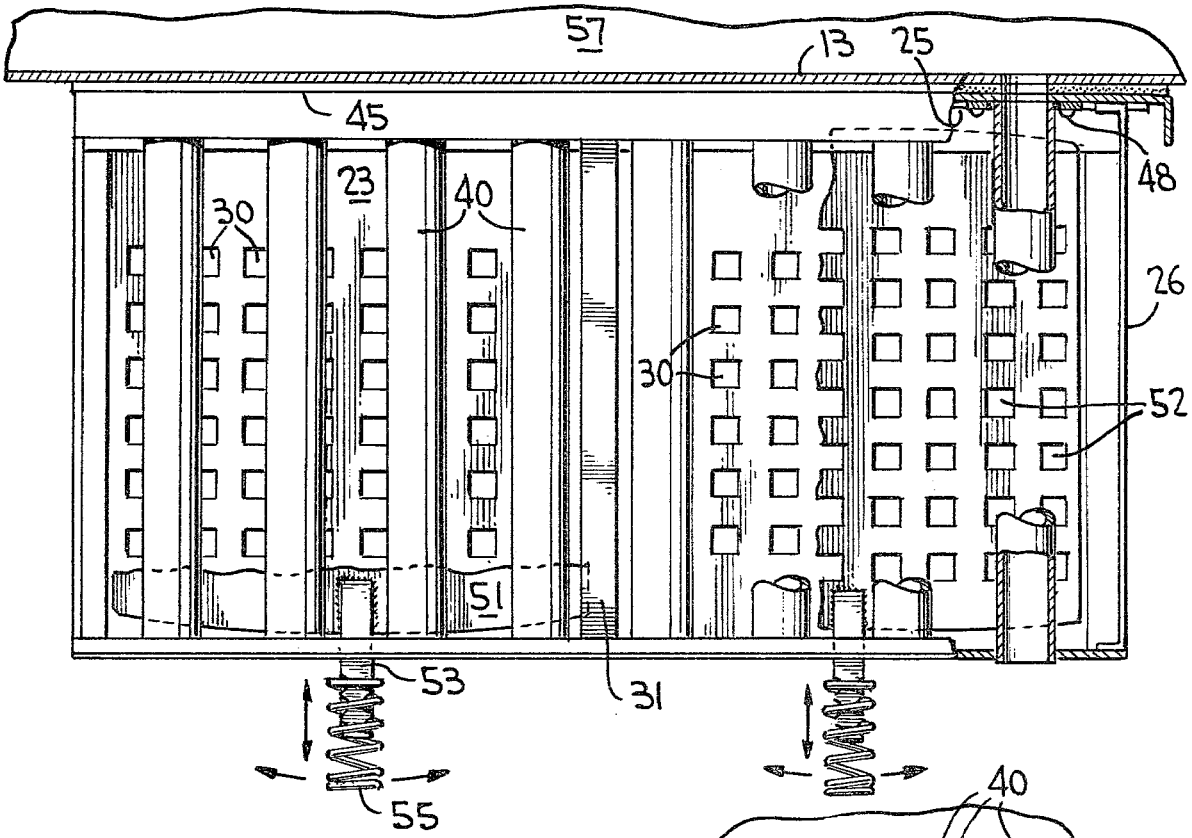
FIG. 4 is a cut-away plan view of the heat exchanger of FIG. 1.
Figure 5:
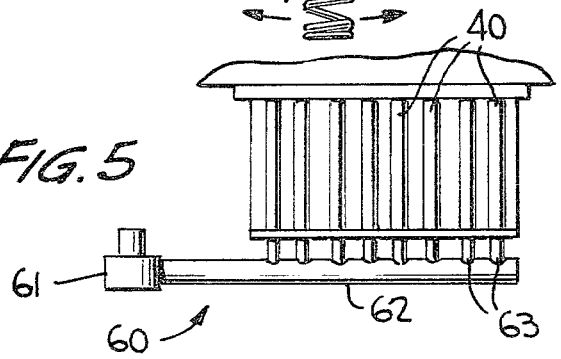
FIG. 5 is a plan view of an inlet manifold which can be attached to the heat exchanger of FIG. 2.

Referring now to FIG. 1 of the drawings, a heat exchanger unit 20 is shown positioned for use in conjunction with a conventional fireplace 10. Fireplace 10 has two side walls 14, a rear wall 13, front frame member 15 and a floor 17. Conventional air inlet openings 11 and outlet openings 12 are situated alongside the fireplace and are connected to each other by a heatalator or heat form 57 which runs alongside the fireplace and in back of rear wall 13, as best illustrated by FIG. 3. Kindling wood 18 is placed atop heat exchanger 20 in order to begin a fire.

Figure 2:
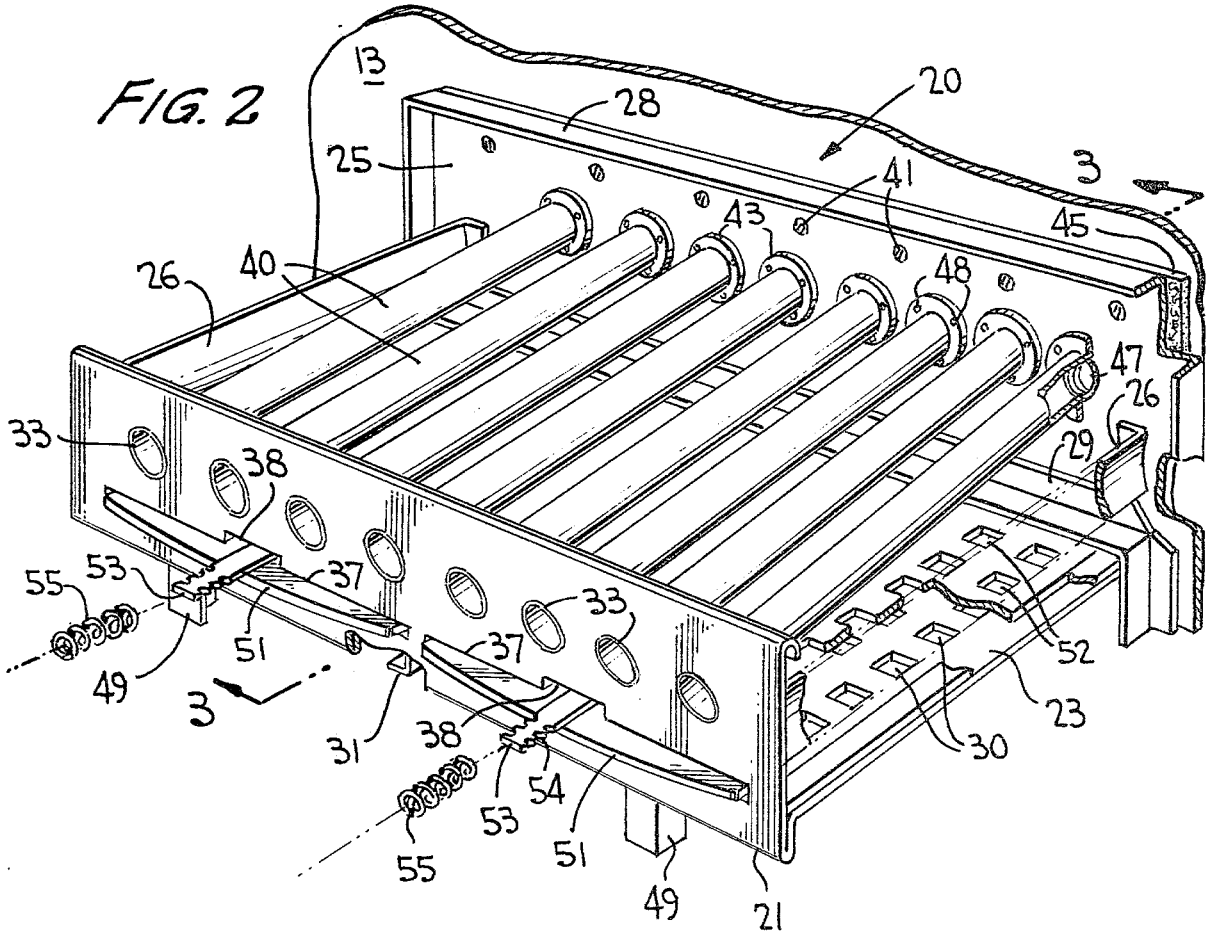
FIG. 2 is a perspective cut-away view of the heat exchanger of FIG. 1.

As best illustrated in FIG. 2, the heat exchanger 20 basically comprises a unitary sheet metal or formed steel frame having a front wall 21, a bottom wall 23 and a rear wall 25. The rear and front walls are generally perpendicular to the bottom wall, and the rear wall extends downwardly far enough to support the frame at that end. Front legs 49 are positioned below the bottom wall near the front wall in order to support the frame along its opposite end and above the fireplace floor. Front wall 21 preferably includes a front wall overhang 22 in order to eliminate the presence of a sharp edge and rear wall 25 similarly includes rear wall ledge 28. A pair of generally U-shaped side walls 26 can be attached between the front and rear walls of the frame by welding, bolting or other conventional means in order to form a five-sided frame having an open top. The side walls are preferably formed of the same sheet material or formed steel as is the remainder of the frame. If it is desired to further strengthen the unit, a front wall reinforcing element 27, as best illustrated by FIG. 3, can be placed adjacent the junction of the front and bottom walls. Similarly, a reinforcing element 29 can be placed adjacent the junction of the rear and bottom walls of the unit. Furthermore, a bottom wall reinforcing element 31 can be placed along the bottom wall of the unit running from the front wall to the rear wall, preferably adjacent the middle of the bottom wall.

A plurality of open-ended heat conductive tubes 40 which are of a material such as stainless steel which is readily heated but not easily burned are placed to connect the front wall 21 to the rear wall 25 and serve to conduct room air through the unit to a fireplace heatalator or heat form 57. The tubes are generally cylindrical, but have slightly ovular ends which are necessitated by the fact that the tubes are slanted upwardly from the front to the rear wall in order to take advantage of the natural convection of the room air which is continuously heated as it passes from the front of the unit to the rear by the kindling wood, charcoal and ashes which lie upon and adjacent to the tubes 40. The tubes are each placed at a first end within cool room air receiving front wall apertures 33, as best illustrated by FIG. 3. Each tube end is slidably fit within and retained by one of the apertures. The other end of each tube is connected to rear wall 25 at rear wall apertures 39 by generally circular rear wall retainer flanges 43 which are in turn attached to the rear wall by conventional gasket mounting fasteners 48. Flanges 43 surround the ends of tubes 40 to retain the tubes against rear wall 25, and a circular wall gasket 47 of fire resistant material is placed between each retainer flange 43 and tube 40 in order to eliminate the introduction of smoke into the heated room air passing through the tubes. Rear wall apertures 39 are positioned at a greater height from bottom wall 23 than are front wall apertures 33 to enable the tubes to be slanted as desired.

The precise number of tubes utilized depends upon their width and the amount of air which is desired to be conducted through the unit to a fireplace heatalator or heat form. A presently preferred unit includes tubes having an inside diameter of approximately 2½ inches with each tube being separated from the other by approximately 2 inches. The use of such tubes with a 16-inch deep fireplace results in the tubes forming an angle $\alpha$ with a line parallel to the floor of the fireplace of approximately 9 degrees. It is important that the tubes be angled in order to take advantage of the natural convection of the continuously heated air passing through the unit.

The heat exchanger unit is connected to the fireplace rear wall 13 by mounting holes 41 through which any type of conventional mounting fasteners 42 are driven. In the event that the rear fireplace wall is corrugated, as are many heat forms and heatalators, it will be necessary to place an optional corrugated attachment (not shown) along the rear wall 25 of the heat exchanger unit. In either event, intermediate the rear wall of the fireplace and the rear wall of the heat exchanger is placed a wall gasket 45 made of fire resistant material and having apertures 46 which mate with heat exchanger rear wall apertures 39 and fireplace rear wall aperture 16, as best illustrated by FIG. 3. The mating of all of these apertures allows the heated air passing through tubes 40 to be conducted directly into the heatalator or heat form 57. If the heat exchanger unit is being built into a fireplace in a new home, the fireplace can be initially formed with apertures 16. If, however, the heat exchanger is being adapted for use with an existing fireplace, it will be necessary to form the apertures 16 in the existing rear fireplace wall 13. To this end, it may be desirable to include tools for forming such apertures in a kit if the heat exchanger unit is sold in disassembled state.

The heat exchanger unit also includes means for simply removing spent kindling wood and charcoal ashes from the fireplace without removing part of the heat exchanger itself. Front wall 21 includes at least one (preferably two) elongated inverted T-shaped slots 37 which are positioned adjacent the bottom of front wall 21. These slots are adapted to receive a slidable cast iron ash shaker grate 51 which, when completely inserted into the elongated slots, will extend from the front wall to the rear wall of the unit. Shaker grates 51 include shaker holes 52 for conducting ashes and other spent kindling wood from the unit to the floor of the fireplace. If the unit includes the optional reinforcing elements 29 and 31, the shaker grate is guided in its movement by the slot formed between the reinforcing elements 31 and bottom wall 23 as best illustrated by FIG. 3. By sliding the shaker grate 51 longitudinally and/or laterally along bottom wall 23, shaker holes 52 will be intermittently aligned with grate holes 30 formed in bottom wall 23. Such alignment will conduct the spent kindling wood and other ashes directly to the floor 17 of the fireplace. The shaker grate 51 is manipulated by means of an attached shaker grate handle 53 and a removable shaker grate handle attachment 55. Handle 53 is attached to the grate 51 by welding or other conventional means and extends outwardly from the grate through elongated slots 37; it can be raised upwardly through the upright central slot portion 38. As it is likely that such handle attached to the cast iron shaker grate will become quite hot as a result of its position adjacent to the hot coals and kindling wood, it is necessary to include a removable shaker grate handle attachment to allow a user to manipulate the shaker grate without danger of being burned. In accordance with this objective, a coil spring handle attachment 55 is screwably mounted upon grooves 54 in handle 53 and is only placed thereupon when it is desired to slide the shaker grate 51.

Although the heat exchanger unit is designed to conduct cool air from an adjacent room through tubes 40 to heatalator 57 by the natural convection of heated air, an optional intake manifold attachment 60 may be included if desired to assist in the propulsion of air through the system. Intake manifold 60 includes an intake blower element 61 which takes air from the adjacent room and blows it into inlet chamber 62 of the manifold. Circular ducts 63, which can be inserted into front wall apertures 33 to connect the attachment to the unit, are connected to the inlet chamber so that the air will be conducted through chambers 62 into ducts 63 and then into tubes 40.

The heat exchanger unit 20 is designed for placement in a fireplace as illustrated FIG. 1, where it is shown that it occupies only a small part of the actual surface area of the fireplace and does not significantly detract from the appearance of the fireplace itself. Additionally, tubes 40 and front wall 21 can be attractively designed or painted to further enhance the attractiveness of the heat exchanger unit.

In operation, heat exchanger unit 20 is attached to rear fireplace wall 13 by mounting holes 41 and mounting fasteners 42 so that apertures 16 and 39 are properly aligned. Kindling wood and/or charcoal is placed atop tubes 40, and as it is heated and begins to crumble it will be positioned between and underneath the tubes in order to continuously surround and heat the tubes and the air passing therethrough. Cool room air enters the heat exchanger through front wall apertures 33 (or through blower 61, if inlet manifold 60 is included) and is immediately heated as it passes by convection through the slanted tubes 40. The air then leaves the tubes and enters heatalator or heat form 57 and is conventionally conducted through heat form 57 into the adjacent room through outlet vents 12 atop the fireplace. This process provides for continual intake of cool room air from the floor of an adjacent room and similar continual entry of heated air into the upper portion of a room through outlet vents 12. Such a process significantly increases the heat efficiency of a conventional fireplace, as the number of inlet openings for air to be heated are greatly increased due to the presence of the plurality of tubular elements in the heat exchanger unit which feed heated air through a conventional heatalator or heat form.

The heat exchanger unit can be sold in kits of disassembled pieces if desired and can be modified to include ornate and decorative front walls and tubes. It may be used in conjunction with existing fireplace structure by simply punching mating holes in a fireplace rear wall, or can be used with a new fireplace structure which has such holes formed therein from the outset. Defective or worn out parts, particularly tubes 40, can be simply replaced by sliding the front ends of the tubes through the apertures 33 in the front wall of the unit. As such tubes normally require replacement during the life of a heat exchanger unit, their manner of attachment to the front and rear walls allows for their simple replacement without removal of the entire unit or the necessity for any tools which might be unavailable to the typical homeowner.

From the foregoing description, one skilled in the art can easily ascertain the essential characteristics of this invention and, without departing from the spirit and scope thereof, can make various changes and modifications of the invention to adapt it to various usages and conditions.

INDUSTRIAL APPLICABILITY

As can be seen from the preceding disclosure, the apparatus of the present invention is useful in providing an improved heat exchanger which can be used with new or existing home heating fireplaces to improve the heating ability thereof.

What is claimed is:

1. A heat exchanger unit suitable for placement along the floor of a fireplace and for connection to a fireplace heat form or heatalator, said heat exchanger unit comprising:

(a) a unitary frame including front and rear walls extending upwardly from opposite sides of a generally rectangular wall;

(b) means for supporting said frame above the floor of said fireplace;

(c) means for attaching said rear wall to a fireplace wall;

(d) means for conducting air from an adjacent room through the frame and into said heat form or heatalator comprising a plurality of generally cylindrical open-ended tubes connected to said front and rear walls wherein the open ends of each of said tubular elements are attached to apertures in said front and rear walls, with one open end of each of said tubular elements placed within one of said front wall apertures and the other open end of each tubular element attached to one of said rear wall apertures, with said rear wall apertures being positioned at a greater height from said bottom wall than said front wall apertures so that said tubular elements slant upwardly from said front wall toward said rear wall for connection to a fireplace heat form or heatalator; and (e) means positioned along said bottom wall for removing ashes from the bottom of said unit.

2. A heat exchanger unit according to claim 1, wherein said supporting means includes a plurality of legs attached to said bottom wall.

3. A heat exchanger unit according to claim 1, further comprising:

(a) two generally U-shaped side walls attached to said front and rear frame walls to form a five-sided enclosure; and (b) reinforcing elements positioned along said front and rear walls adjacent said opposite sides of said bottom wall.

4. A heat exchanger unit according to claim 1, wherein said ash removing means comprises a plurality of grate holes in said bottom wall.

5. A heat exchanger unit according to claim 4, wherein said ash removing means further comprises at least one elongated slot in said front wall adjacent to a bottom portion thereof and an ash shaker slidable in each of said slots, said ash shaker comprising a flat member having a plurality of shaker holes therein, a handle extending outwardly from said member and said slot and a handle attachment removably connected to said handle.

6. A heat exchanger unit according to claim 5, wherein said handle attachment comprises a coil spring detachably mounted upon grooves in said handle.

7. A heat exchanger unit according to claim 1, wherein said air conducting means further comprises a blower-assisted intake manifold.

8. A heat exchanger unit suitable for placement along the floor of a fireplace and for connection to a conventional fireplace heat form or heatalator, said heat exchanger comprising:

(a) a unitary frame including front and rear walls extending upwardly from opposite sides of a generally rectangular bottom wall, said front and rear wall each having a matching plurality of spaced apertures located above said bottom wall, said rear wall apertures positioned at a greater height from said bottom wall than said front wall apertures, said front wall further having at least one elongated slot therein located below said apertures, said rear wall further having a plurality of mounting holes located therein, and said bottom wall including a plurality of grate holes;

(b) two opposed, generally U-shaped side walls, each side wall being attached to said front and rear walls;

(c) a plurality of generally cylindrical open-ended tubes connected to said front and rear walls intermediate said side walls, the respective open ends of each tube being attached to one of said front wall apertures and one of said rear wall apertures, said tubes being slanted upwardly from said front wall toward said rear wall;

(d) an ash shaker slidable in each of said elongated slots, said ash shaker including a flat member having a plurality of shaker holes therein, a handle extending from one side of said flat member through said elongated slots and a handle attachment removably connected to said handle;

(e) means for removably retaining said tubular elements on said front and rear walls; and (f) means for attaching said rear wall to a fireplace wall.

9. A heat exchanger unit according to claim 1, further comprising a blower-assisted intake manifold attached to said front wall.

* * * * *